US008161622B2

(12) United States Patent
King et al.

(10) Patent No.: US 8,161,622 B2
(45) Date of Patent: Apr. 24, 2012

(54) RIVETING APPARATUS

(75) Inventors: Richard Paul King, Welwyn (GB); Terence Gilbert, Welwyn Garden (GB)

(73) Assignee: Avdel UK Limited, Welwyn Garden City, Hertfordshire (GB)

( * ) Notice: Subject to any disclaimer, the term of this patent is extended or adjusted under 35 U.S.C. 154(b) by 474 days.

(21) Appl. No.: 12/303,181

(22) PCT Filed: Jul. 10, 2007

(86) PCT No.: PCT/GB2007/002571

§ 371 (c)(1),
(2), (4) Date: Jan. 22, 2009

(87) PCT Pub. No.: WO2008/040926

PCT Pub. Date: Apr. 10, 2008

(65) Prior Publication Data

US 2009/0205192 A1 Aug. 20, 2009

(30) Foreign Application Priority Data

Oct. 3, 2006 (GB) ..... 0619430.2

(51) Int. Cl.
*B21D 39/00* (2006.01)
*B23P 11/00* (2006.01)

(52) U.S. Cl. ..... 29/524.1; 29/243.521

(58) Field of Classification Search ..... 29/524.1, 29/525.06, 243.521, 243.528, 525, 525.05, 29/34 B, 758, 759, 761, 811.2, 812.5, 816, 29/818; 72/543.17, 453.14; 227/55, 63
See application file for complete search history.

(56) References Cited

U.S. PATENT DOCUMENTS 3,328,985 A 7/1967 Keymer

FOREIGN PATENT DOCUMENTS

| | | | |
|---|---|---|---|
| EP | 1 609 546 | A1 | 12/2005 |
| GB | 648 429 | | 1/1951 |
| GB | 1 004 361 | | 9/1965 |
| GB | 2 301 547 | A | 12/1996 |
| GB | 2 338 670 | A | 12/1999 |
| GB | 2 357 056 | A | 6/2001 |
| GB | 2 374 825 | A | 10/2002 |

OTHER PUBLICATIONS

The Search Report from the Intellectual Property Office of Great Britain which issued in connection with corresponding British Application No. 0619430.2.

*Primary Examiner* — John C Hong
(74) *Attorney, Agent, or Firm* — Hahn, Loeser & Parks LLP; Arland T. Stein

(57) ABSTRACT

A riveting tool for placing a blind breakstem rivet includes a body; a nose casing securable to the body, the nose casing having a nose tip having a nose tip; a jaw housing inside the nose casing, the jaw housing containing jaws for gripping and pulling a rivet stem in use, the jaw housing having an end which incorporates an aperture through which the jaws are urged towards the nose tip by resilient biasing means; and adjustment means configured to adjust a distance from the end of the jaw housing to an inside of the nose tip. Also provided is a nose casing for a riveting tool and a method for altering the jaw separation distance of a riveting tool prior to gripping a rivet stem.

20 Claims, 10 Drawing Sheets

RIVETING APPARATUS

RELATED/PRIORITY APPLICATION

This application is a National Phase filing regarding International Application No. PCT/GB2007/002571, filed on Jul. 10, 2007. International Application No. PCT/GB2007/002571 relies upon British Application No. 0619430.2, filed on Oct. 3, 2006 for priority.

This invention relates to a riveting tool, and more particularly to a riveting tool for placing blind, breakstem, rivets.

Such rivets comprise a generally tubular shell, and a stem extending through the shell and protruding from one end thereof. In use, the shell is inserted through suitable aligned apertures in workpieces to be joined together, and a riveting tool is applied to the rivet and is operated to place the rivet. The tool comprises a hollow nosepiece at the forward end of which is an annular anvil for contacting that end of the rivet shell from which the rivet stem protrudes through the annular anvil, and, inside the hollow nosepiece, stem-gripping jaws (or another such stem-engaging device) into which protrudes at least one part of the rivet stem remote from the shell. In use, the stem-gripping jaws (or other stem-engaging device) are retracted with respect to the anvil, thereby engaging the stem and applying tension to it with respect to the shell. This causes the shell to deform and rivet the workpieces together, and the part of the stem remote from the shell thereafter breaks off to leave minimal protrusion of the rivet from the workpieces.

Usually the tool comprises a body on which the nosepiece is mounted, with the anvil at the end thereof remote from the body. The stem-gripping jaws (or other stem-engaging device) are reciprocably moveable with respect to the nosepiece by means of a piston, which is commonly a pneumatic, or hydro-pneumatic or electro-hydro-pneumatic device contained within the body or part of the body.

Such rivets are called 'blind rivets' because they can be installed by access to only one side of the workpieces. An example of such rivets are those well known and readily available in many countries of the world under the registered trademark AVEX. Hydro-pneumatic tools for installing them are well known and readily available under the registered trademark GENESIS. Such a tool is described, for example, in GB 2301547 A, with the exception of the anvil and stem-engaging device, for which the reader is referred, for example, to GB 1004361 A. Further background art is provided in GB 2357056 A.

Different rivet stems have different diameters, depending on the model or type of rivet and its intended application. Accordingly, different rivet stems require a different amount of jaw release (i.e. jaw separation distance) in the tool, for receiving the rivet stem before the stem is gripped by the jaws, and for releasing the stem after the rivet has been installed. In order to cater for a range of rivet stem diameters, tools generally provide a relatively large amount of jaw release. However, this means that the jaws may need to close a considerable amount before a small diameter rivet stem is gripped and the installation process can begin. In some cases, there can be up to 5 mm of lost stroke of the jaws before the stem is gripped and the fastener is moved.

This lost stroke is considered to be unnecessary. The movement of the jaws, for "taking up the slack", is lost motion, takes up valuable time, and delays the beginning of each rivet installation. Moreover, it can incorrectly give the impression to the operator that the tool is somehow "struggling" or "winding up" before the installation process visibly begins (i.e. when the rivet stem is eventually gripped and pulled).

This problem is relevant to all breakstem riveting tools, but is particularly relevant to portable battery-powered tools. This is because, with battery-powered tools, the speed of the jaw movement is slower, and hence the delay before the rivet stem is gripped is more significant. Also, the energy expended in moving the jaws before the rivet stem is gripped uses valuable battery power, and may lead to fewer rivets being able to be installed before the battery needs to be replaced.

There is therefore a desire for a simple-to-use adjustment mechanism for the riveting tool, suitable for use with a range of different tools and fastener types, and over a range of stem diameters, to minimise the amount of lost motion of the jaws, to enable the diameter of the rivet stem to be taken into account, and to enable the rivet stem to be gripped and pulled more quickly.

According to a first aspect of the present invention there is provided a riveting tool for placing a blind breakstem rivet, the tool comprising: a body; a nose casing securable to the body, the nose casing having a nose tip; a jaw housing inside the nose casing, the jaw housing containing jaws for gripping and pulling a rivet stem in use, the jaw housing having an end which incorporates an aperture through which the jaws are urged towards the nose tip by resilient biasing means; and adjustment means by which the distance from the end of the jaw housing to the inside of the nose tip may be adjusted.

The term "nose tip" as used herein should be interpreted broadly, to encompass a separate nose tip component that is attached to the nose casing in use, or an integral part of the end of the nose casing.

The jaw release (or jaw separation) distance, before the jaws start to move to grip and pull the rivet stem, is determined by the amount by which the jaws protrude through the aperture in the end of the jaw housing. The amount by which the jaws protrude through the end of the jaw housing is determined by the distance from the end of the jaw housing to the inside of the nose tip. Thus, the distance from the end of the jaw housing to the inside of the nose tip regulates the jaw release distance. Accordingly, by providing means by which the distance from the end of the jaw housing to the inside of the nose tip may be adjusted, this advantageously enables the release distance to be adjusted. Thus, the user is able to fine tune the jaw release distance of the tool, such that the jaw release distance is only slightly greater than the diameter of the rivet stem. As a consequence, once a rivet is inserted and the installation procedure is begun, the jaws can almost instantly grip and pull the rivet stem. This saves time and energy, which is particularly relevant for slower battery-powered tools, and also means that there is minimal lost motion in the tool.

Preferably the adjustment means comprise adjustable securing means for securing the nose casing to the body, the securing means being adjustable to thereby move the nose tip towards or away from the end of the jaw housing.

Particularly preferably such securing means comprise a thread on the nose casing, engageable with a corresponding thread on the body, thereby enabling adjustment of the distance from the end of the jaw housing to the inside of the nose tip. Such threads advantageously enable the jaw release distance to be virtually infinitely adjustable over a range of values, thereby enabling the tool to be optimised to suit a range of fastener stem diameters.

Preferably the securing means further comprise a locking nut on the thread on the nose casing, the locking nut being tightenable against the body in use.

Preferably the locking nut obscures the thread on the nose casing in use. This advantageously prevents the thread from being blocked with dirt or debris during use, which could impede subsequent adjustment of the nose casing.

Preferably the adjustment means further comprise indicator means indicative of the distance from the end of the jaw housing to the inside of the nose tip. The indicator means may comprise one or more circumferential grooves around the nose casing. The grooves may be arranged to align with an end of the locking nut in use. Alternatively, the indicator means may comprise one or more detents.

It will be appreciated that, if the adjustment of the nose casing is effected by means of a threaded portion of the nose casing adjustably engaging with a threaded portion of the body, then the threaded portions will need to be sufficiently long to enable them to be adjusted as required. A tool body having an insufficiently long threaded portion can advantageously be adapted to receive a nose casing having a longer threaded portion by means of an adaptor member, the adaptor member comprising: a first part for attaching to the body; and a second part arranged to provide an extended thread on the body for engagement with the thread on the nose casing, the thread on the second part being sufficiently long to enable adjustment of the distance from the end of the jaw housing to the inside of the nose tip by rotation of the nose casing relative to the adaptor member.

According to a second aspect of the present invention there is provided a nose casing for a riveting tool, the nose casing having a nose tip or being configured to receive a nose tip, the nose casing incorporating adjustment means by which the distance from the inside of the nose tip to the end of the jaw housing of a riveting tool may be adjusted.

According to a third aspect of the invention there is provided a method for altering the jaw separation distance of a riveting tool prior to gripping a rivet stem, said riveting tool being in accordance with the first aspect of the invention, said method comprising adjusting the distance from the end of the jaw housing to the inside of the nose tip.

Embodiments of the invention will now be described, by way of example only, and with reference to the drawings in which.

In the figures, like elements are indicated by like reference numerals throughout.

Figure 9:
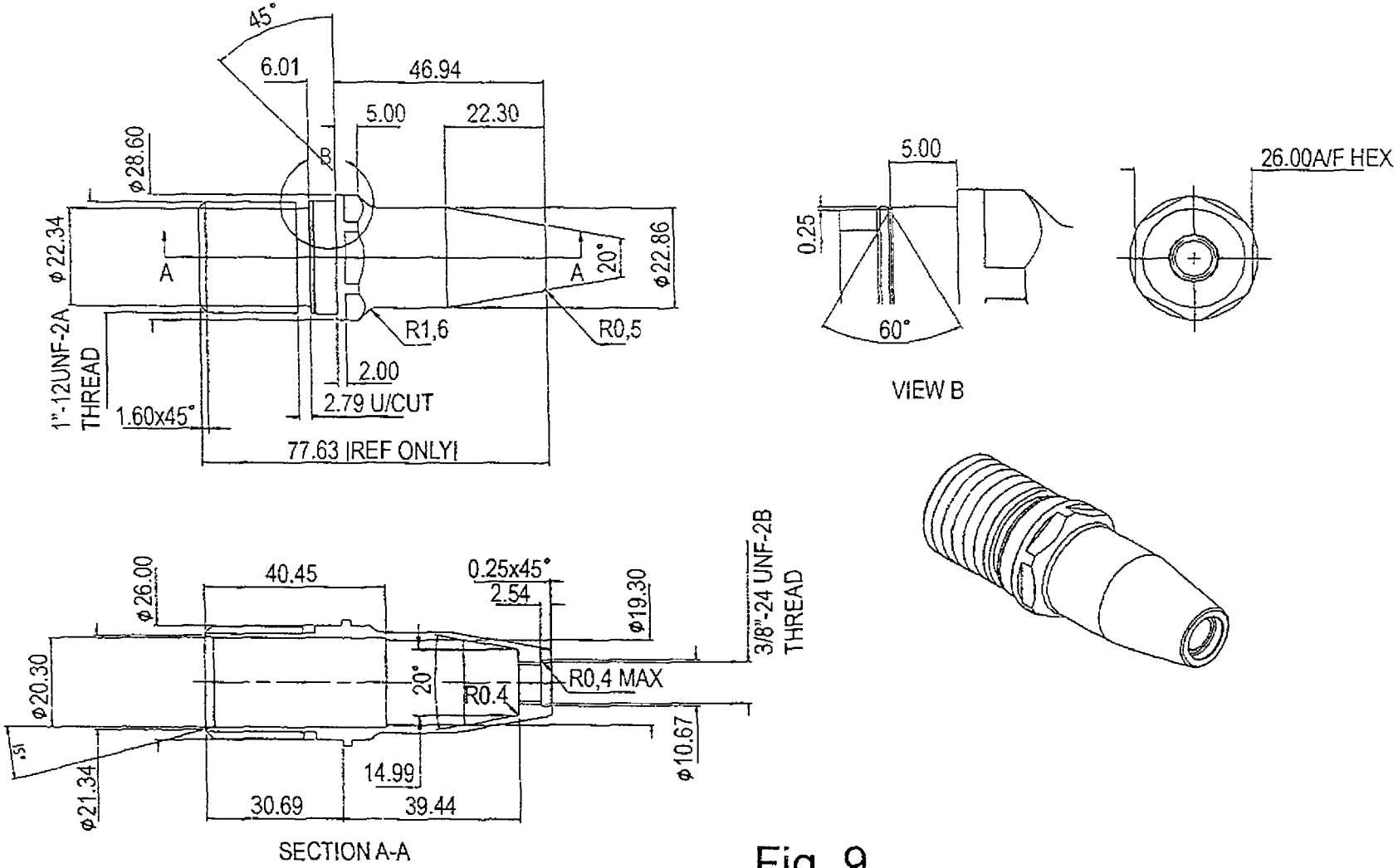
FIG. 9 illustrates views of the nose casing with example dimensions in millimetres.
Figure 10:
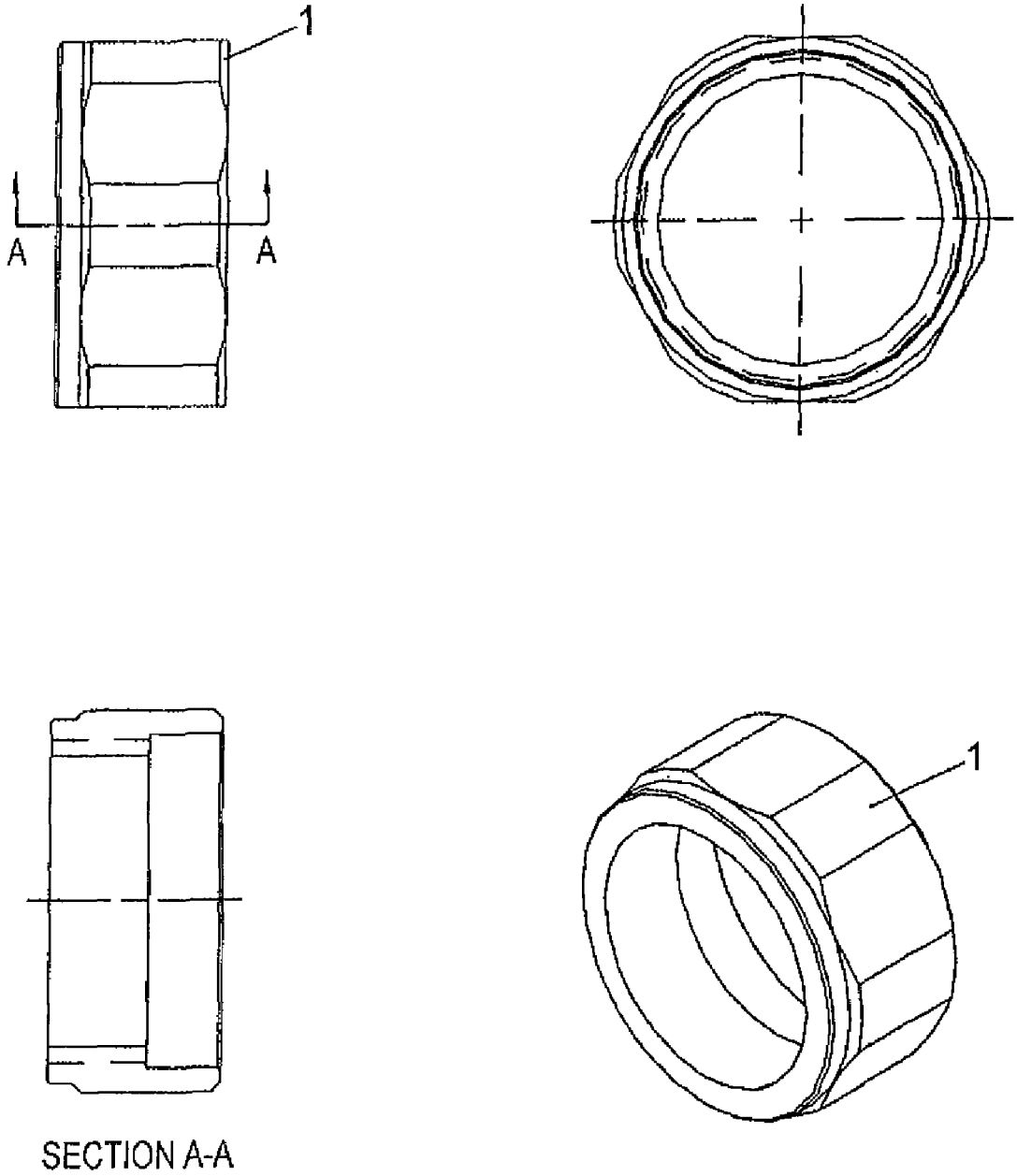
FIG. 10 illustrates views of the locking nut.
Figure 11:
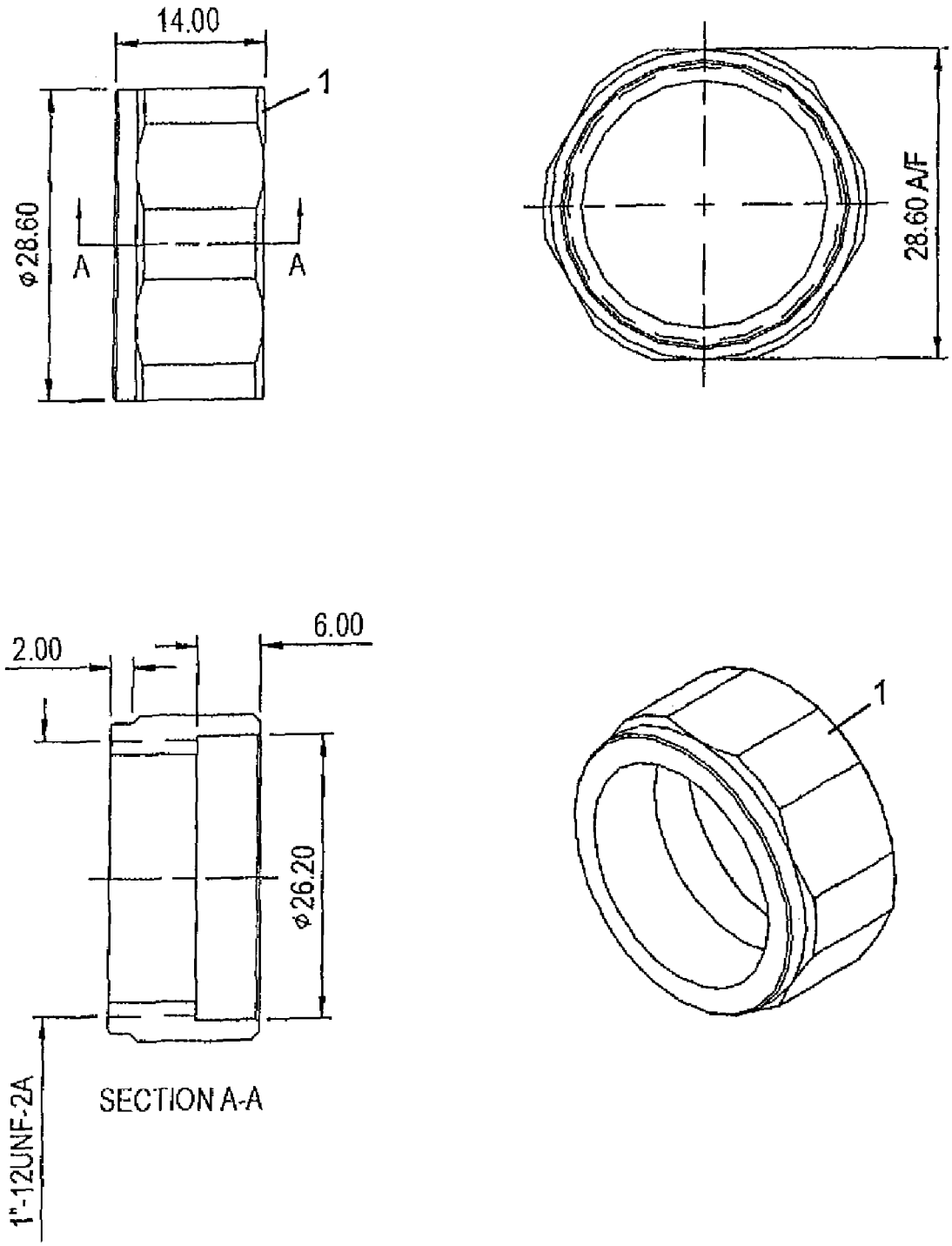
FIG. 11 illustrates views of the locking nut with example dimensions in millimetres.

The dimensions in FIGS. 9 and 11 are provided by way of example only, as embodiments may be made in a variety of shapes and sizes.

The present embodiments represent the best ways known to the applicant of putting the invention into practice. However they are not the only ways in which this can be achieved.

DETAILED DESCRIPTION OF THE DRAWINGS

Figure 1:
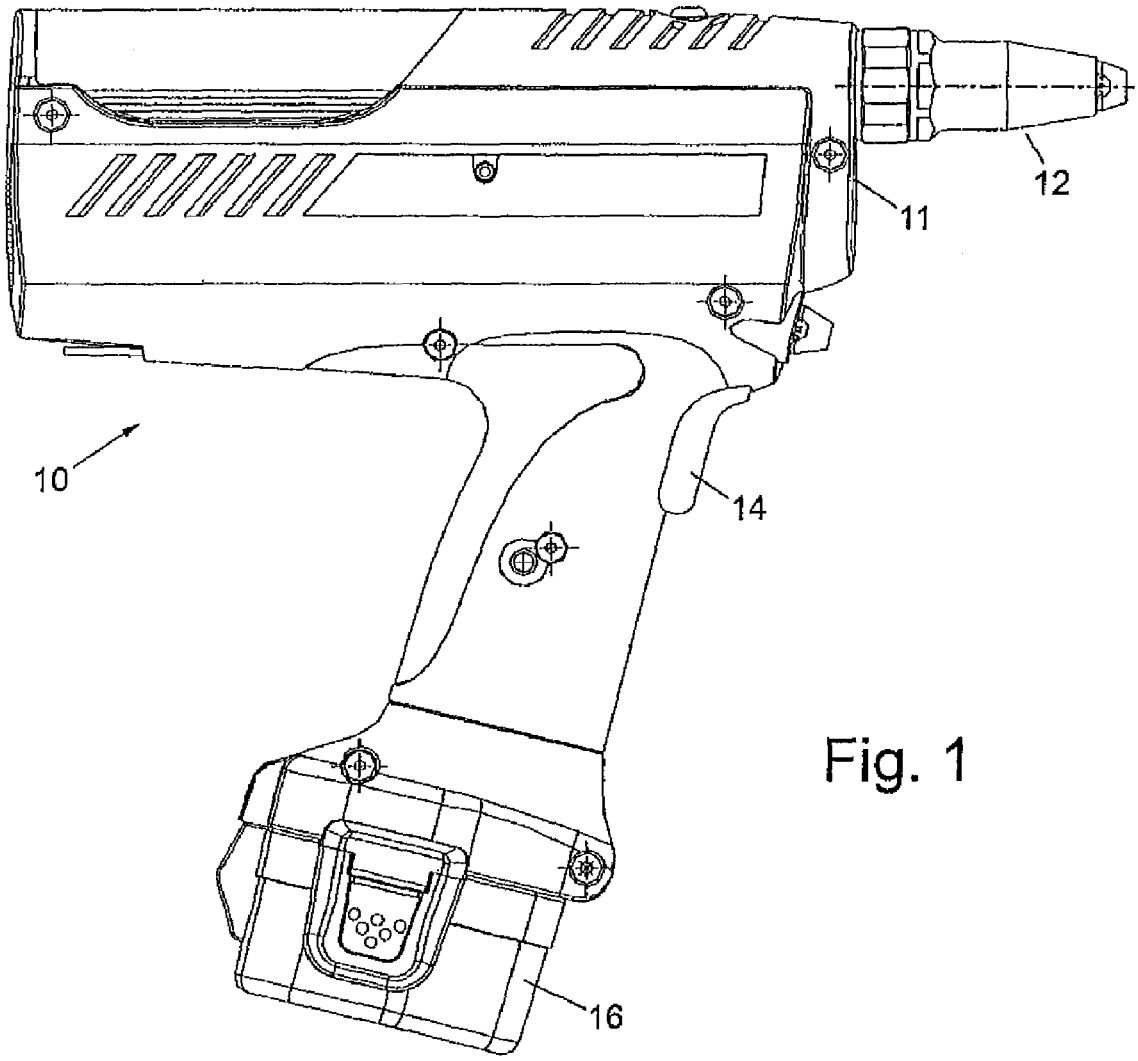
FIG. 1 illustrates an overview of the exterior of a riveting tool embodying the present invention.

FIG. 1 shows a riveting tool 10, which in this example is portable with a rechargeable battery pack 16. A trigger 14 is provided for use by an operator for installing a rivet.

Figure 2:
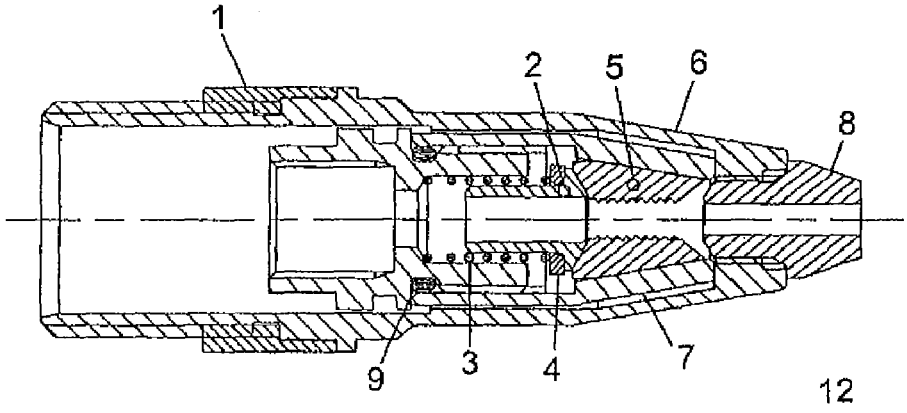
FIG. 2 illustrates the construction of the nose casing and jaw housing.

Attached to the front end of the upper body part 11 of the tool 10 is a tubular nosepiece 12. As illustrated in more detail in FIG. 2, the tubular nosepiece 12 comprises a tubular nose casing 6, at the forward end of which is secured a tapered nose tip 8 which provides an annular anvil for contacting the head of a rivet in use. Inside the tubular nose casing 6 are rivet stem-engaging means in the form of a pulling-jaw assembly. As is usual in such tools, the jaw assembly comprises an outer jaw housing 7 providing an inner tapered collet into which jaws 5 are urged by a helical compression spring 3 acting against a jaw spreader 2. The stem of a rivet is inserted through the nose tip 8. When the tool is actuated by depressing the trigger 14, the jaws 5 retract and close to grip the stem of the rivet, and then the jaws 5 are retracted with respect to the nose tip 8, pulling the rivet stem, so that the rivet is placed, or set, by deformation of its tubular shell.

The construction and operation of the tool, as so far described above, is well known and understood in the art of blind riveting.

When receiving a rivet, the separation distance of the jaws 5, also known as the jaw release distance, is determined by the amount by which the jaws 5 protrude through the aperture in the end of the tapered jaw housing 7. The amount by which the jaws 5 protrude through the end of the jaw housing 7 is determined by the distance from the end of the jaw housing 7 to the inside of the nose tip 8. Thus, the distance from the end of the jaw housing 7 to the inside of the nose tip 8 regulates the jaw release distance.

In the present embodiments, the distance from the end of the jaw housing 7 to the inside of the nose tip 8 is adjustable, which advantageously enables the jaw release distance to be adjusted. In the presently preferred embodiments, this is achieved by virtue of the nose casing 6 being adjustable with respect to the body 11 of the tool 10.

As illustrated in FIGS. 7 to 11, the nose casing 6 is provided with an elongate threaded region 22 which screws onto a corresponding thread formed around the cylinder 13 of the body 11 of the tool 10. The threaded region 22, and the corresponding thread on the body 11, are both sufficiently long to enable the nose casing 6 to be securely attached to the body 11, whilst nevertheless providing adjustability of the distance to which the nose casing 6 protrudes from the body 11. In this manner, by screwing the threaded region 22 further into the body 11, or partially unscrewing the threaded region 22 from the body 11, the distance from the end of the jaw housing 7 to the inside of the nose tip 8 can be regulated. A flange 24 is formed around the nose casing 6 to facilitate screwing the threaded region 22 into or out of the body 11, for example using a spanner or wrench or such like.

A locking nut 1 is provided to fix the extent of protrusion of the nose casing 6 from the body 11. In use, the locking nut 1 is tightened against the body 11 of the tool 10, again using a spanner or wrench, for example.

In use, the nose casing 6 may be attached to the body 11 of the tool 10 in an extended configuration (as shown in FIGS. 3, 4, 7*c* and 7*d*), or a retracted configuration (as shown in FIGS. 5, 6, 7*a* and 7*b*), or in an intermediate configuration somewhere between the two.

Figure 3:
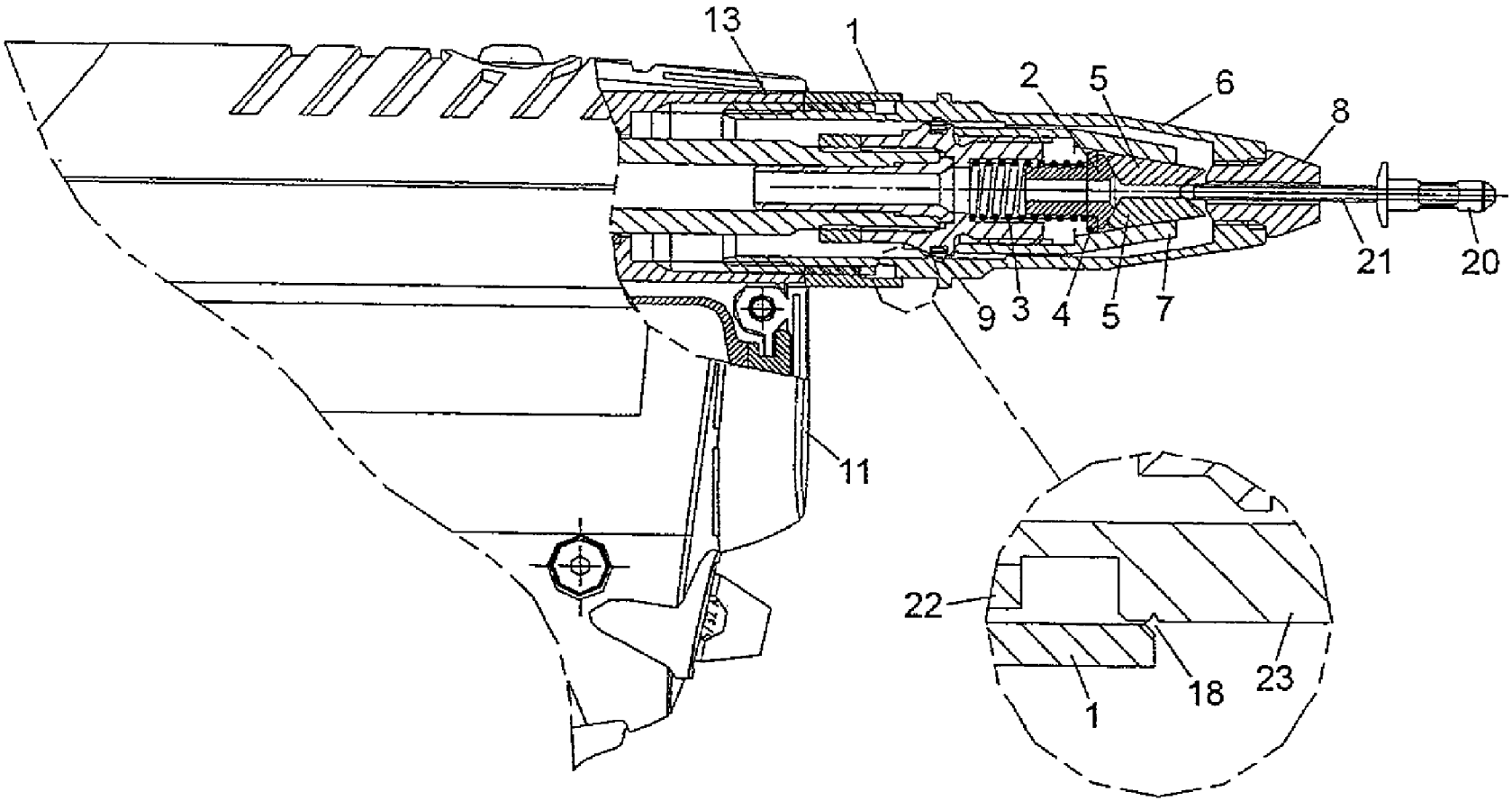
FIGS. 3 and 4 illustrate the nose casing in an extended position relative to the end of the jaw housing, thereby giving a minimum jaw release distance.
Figure 4:
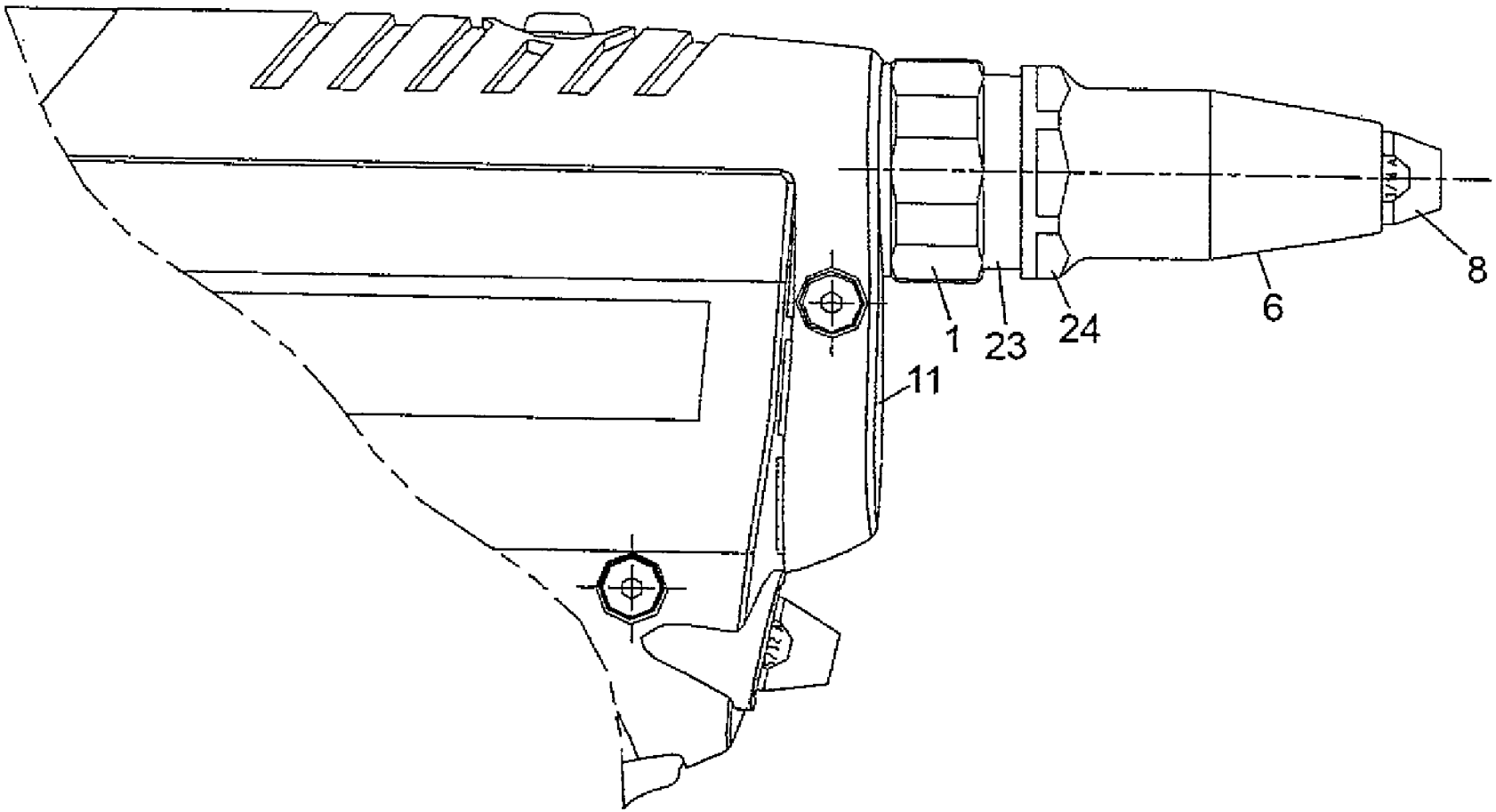

As shown in FIGS. 3 and 4, setting the nose casing 6 to a position of maximum extension from the body 11 enables the jaws 5 to protrude from the end of the jaw housing 7 by a maximum amount, which in turn provides minimum jaw release, suitable for receiving a rivet 20 having a stem 21 of small diameter.

Figure 5:
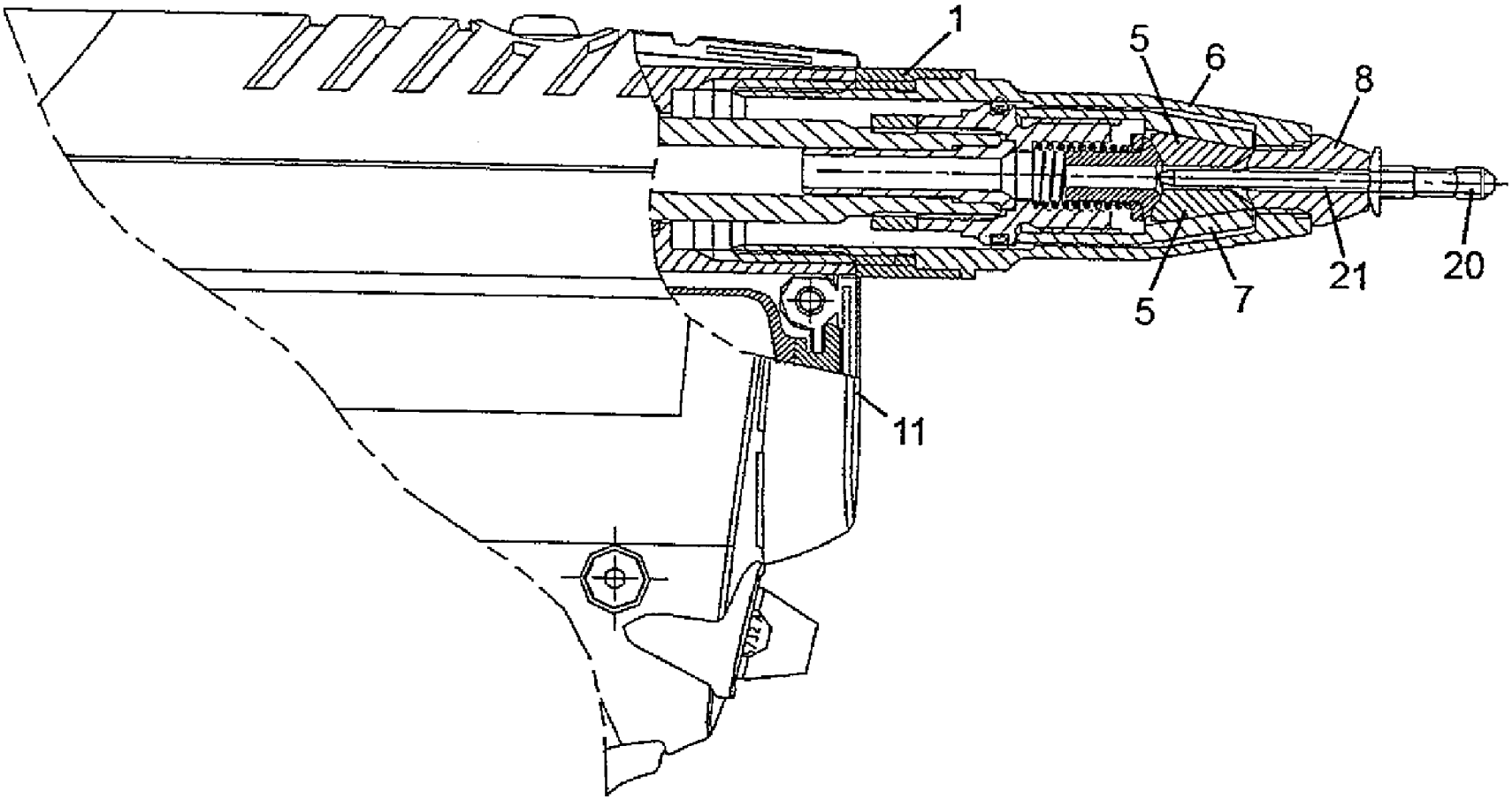
FIGS. 5 and 6 illustrate the nose casing in an retracted position relative to the end of the jaw housing, thereby giving a maximum jaw release distance.
Figure 6:
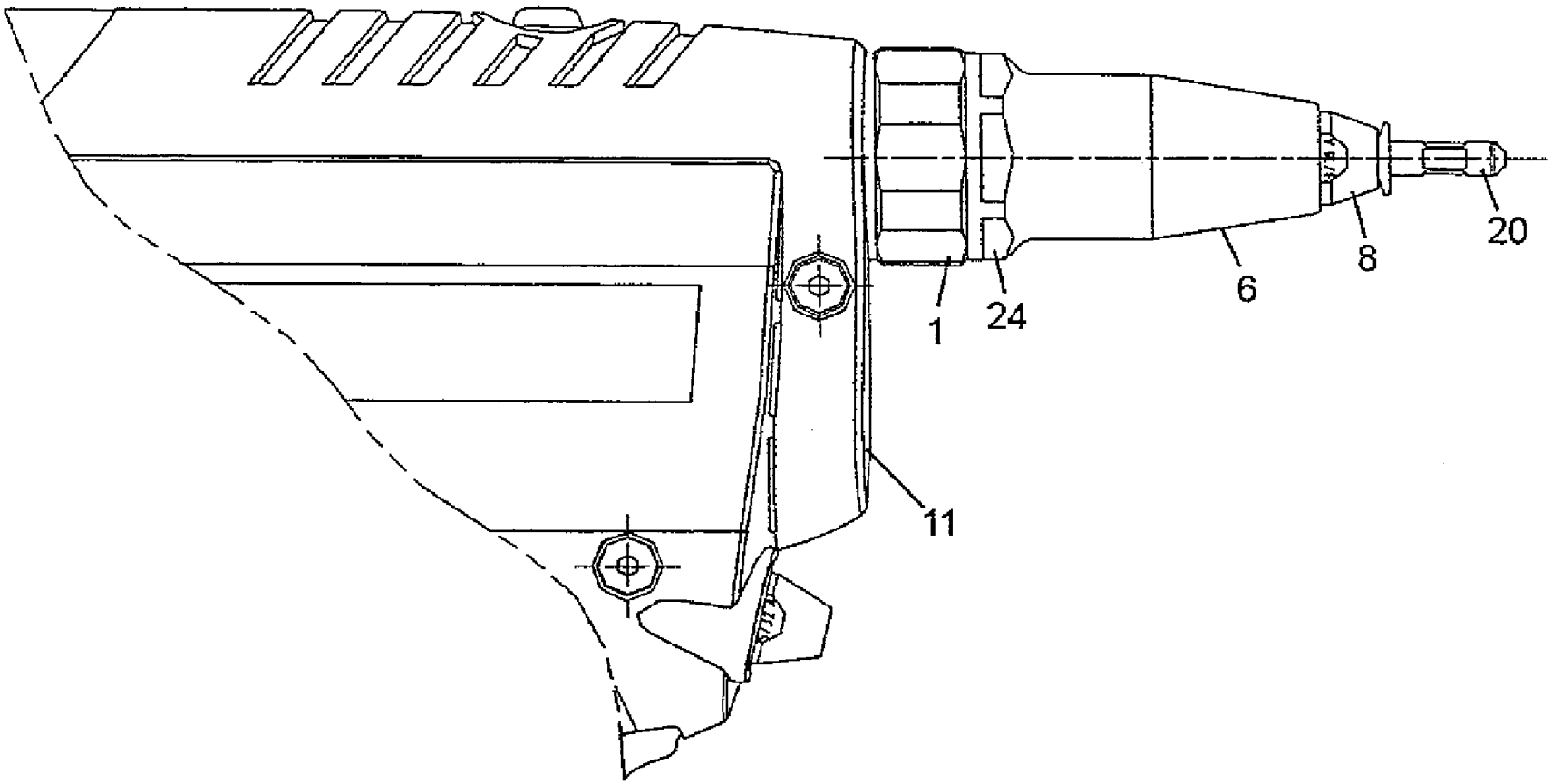
Figure 7A:
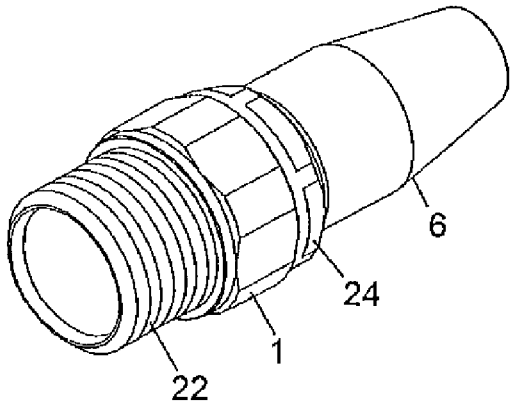
FIG. 7 illustrates the nose casing with a locking nut in retracted and extended configurations.
Figure 7B:
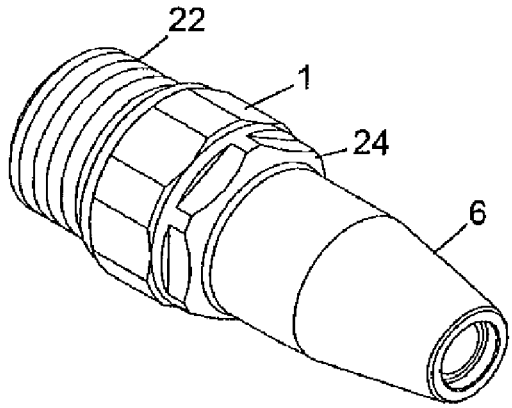
Figure 7C:
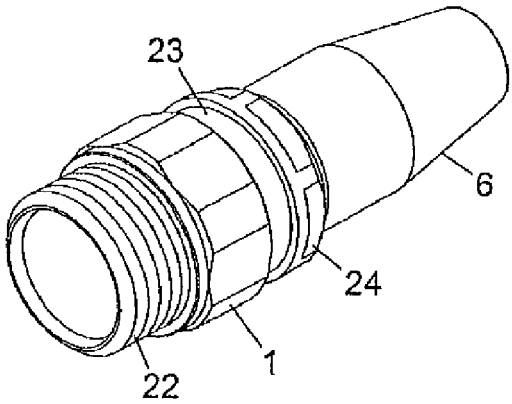
Figure 7D:
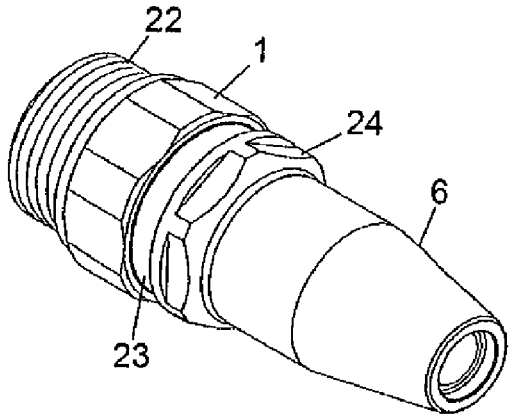
Figure 8:
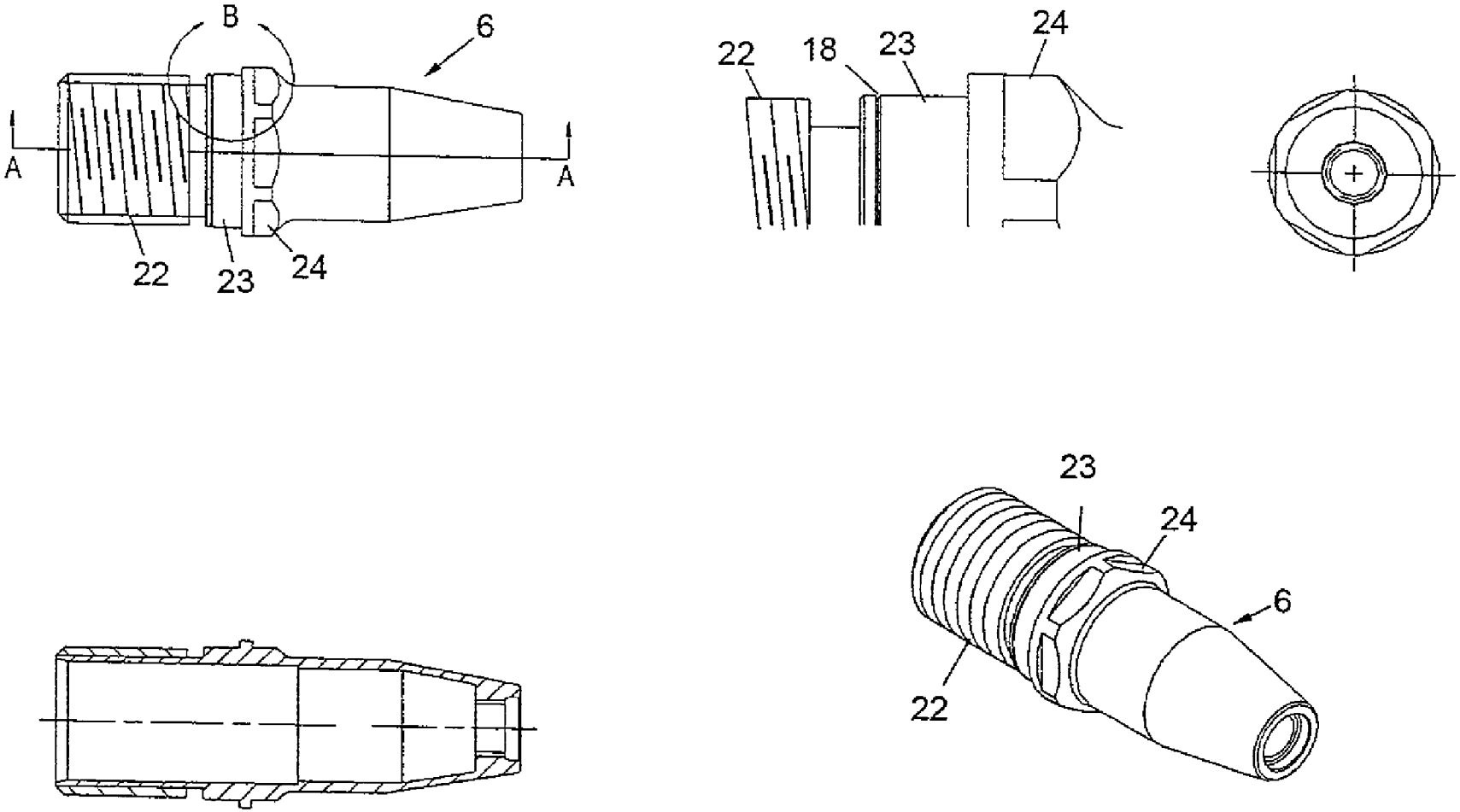
FIG. 8 illustrates views of the nose casing.

Conversely, as shown in FIGS. 5 and 6, setting the nose casing 6 to a retracted position of minimum extension from the body 11 causes the jaws 5 to be pushed fully within the jaw housing 7 by the inside of the nose tip, which in turn provides maximum jaw release, suitable for receiving a rivet 20 having a wide diameter stem 21.

Thus, the user is able to fine tune the jaw release distance of the tool 10, such that the jaw release distance is only slightly greater than the diameter of the rivet stem 21. As a consequence, once a rivet 20 is inserted and the installation procedure is begun, the jaws 5 can almost instantly grip and pull the rivet stem 21. This saves time and energy, which is particularly relevant for slower battery-powered tools, and also means that there is minimal lost motion in the tool.

As shown in FIGS. 3 and 4, in the present embodiment, the maximum extension of the nose casing 6 is 5 mm from its retracted position. To assist the user when setting the nose casing 6 in the position of maximum extension, a circumferential indicator groove 18 is provided around the nose casing 6, at the end of the threaded region 22. In the configuration of maximum extension, the nose casing 6 is extended such that the end of the locking nut 1 distal from the body 11 aligns with the indicator groove 18.

An unthreaded region 23 is provided between the indicator groove 18 and the flange 24. As shown in FIGS. 5 and 6, the locking nut 1 covers the unthreaded region 23 when the nose casing 6 is set in the retracted position of minimum extension. In this position, the locking nut 1 is immediately adjacent to the flange 24.

Further indicator grooves may be provided within the unthreaded region, for example to correspond with positions of intermediate extension of the nose casing 6 from the body 11. In alternative embodiments, one or more detents may be provided to serve as indicator means.

In use, the locking nut 1 obscures the threaded region 22 of the nose casing 6, over the full range of extension of the nose casing. This prevents the thread from being blocked with dirt or debris during use, which could impede subsequent adjustment of the nose casing 6.

The locking nut 1 and flange 24 are both preferably of a full hex form, but it will be appreciated that they can alternatively be of other geometries.

The cylinder 13 of the tool 10, onto which the nose casing 6 is attached, preferably has a longer threaded region than that of conventional riveting tools, in order to enable the nose casing 6 to be securely attached to the body 11, whilst nevertheless enabling the nose casing 6 to be extended. To enable the nose casing 6 to be used with a conventional riveting tool, an adaptor member may be fitted to the conventional tool. The adaptor member may comprise a first threaded part for attaching to the body of the conventional tool, and a second threaded part arranged to provide an extended thread on the body, for engagement with the threaded region 22 of the nose casing 6.

Thus, the nose casing 6 of the present invention may be used interchangeably with standard riveting tools and standard nose equipment, and may be used for installing a range of standard fasteners.

The invention claimed is:

1. A riveting tool for placing a blind breakstem rivet, the tool comprising:

a body;

a nose casing securable to the body, the nose casing having a nose tip;

a jaw housing inside the nose casing, the jaw housing containing jaws for gripping and pulling a rivet stem in use, the jaw housing having an end which incorporates an aperture through which the jaws are urged towards the nose tip by resilient biasing means; and adjustment means configured to adjust a distance from the end of the jaw housing to an inside of the nose tip thereby to adjust a separation of the jaws and an amount of movement of the jaws required to grip a rivet stem.

2. A riveting tool as claimed in claim 1, wherein the adjustment means comprise adjustable securing means for securing the nose casing to the body, the securing means being adjustable to thereby move the nose tip towards or away from the end of the jaw housing.

3. A riveting tool as claimed in claim 2, wherein the securing means comprise a thread on the nose casing, engageable with a corresponding thread on the body, thereby enabling adjustment of the distance from the end of the jaw housing to the inside of the nose tip.

4. A riveting tool as claimed in claim 3, wherein the securing means further comprise a locking nut on the thread on the nose casing, the locking nut being tightenable against the body in use.

5. A riveting tool as claimed in claim 4, wherein the locking nut obscures the thread on the nose casing in use.

6. A riveting tool as claimed in claim 3, further comprising an adaptor member, the adaptor member comprising: a first part for attaching to the body; and a second part arranged to provide an extended thread on the body for engagement with the thread on the nose casing, the thread on the second part being sufficiently long to enable adjustment of the distance from the end of the jaw housing to the inside of the nose tip by rotation of the nose casing relative to the adaptor member.

7. A riveting tool as claimed in claim 1, wherein the adjustment means further comprise indicator means indicative of the distance from the end of the jaw housing to the inside of the nose tip.

8. A riveting tool as claimed in claim 7, wherein the indicator means comprise one or more circumferential grooves around the nose casing.

9. A riveting tool as claimed in claim 8, wherein the one or more circumferential grooves around the nose casing are arranged to align with an end of the locking nut in use.

10. A riveting tool as claimed in claim 7, wherein the indicator means comprise one or more detents.

11. A method for altering the jaw separation distance of a riveting tool prior to gripping a rivet stem, said riveting tool being as claimed in claim 1, said method comprising adjusting the distance from the end of the jaw housing to the inside of the nose tip.

12. A nose casing for a riveting tool, the nose casing having a nose tip or being configured to receive a nose tip, the nose casing incorporating adjustment means configured to adjust a distance from an inside of the nose tip to an end of a jaw housing of a riveting tool thereby to adjust a separation of jaws in the jaw housing and an amount of movement of the jaws required to grip a rivet stem.

13. A nose casing as claimed in claim 12, wherein the adjustment means comprise adjustable securing means for securing the nose casing to a body of the riveting tool, the securing means being adjustable to thereby move the nose tip towards or away from the end of the jaw housing of the riveting tool.

14. A nose casing as claimed in claim 13, wherein the securing means comprise a thread on the nose casing, engageable with a corresponding thread on the body of the riveting tool, thereby enabling adjustment of the distance from the inside of the nose tip to the end of the jaw housing of the riveting tool by rotation of the nose casing relative to the body of the riveting tool.

15. A nose casing as claimed in claim 14, wherein the securing means further comprise a locking nut on the thread on the nose casing, the locking nut being tightenable against the body of the riveting tool in use.

16. A nose casing as claimed in claim 15, wherein the locking nut obscures the thread on the nose casing in use.

17. A nose casing as claimed in claim 12, wherein the adjustment means further comprise indicator means indicative of the distance from the inside of the nose tip to the end of the jaw housing of the riveting tool.

18. A nose casing as claimed in claim 17, wherein the indicator means comprise one or more circumferential grooves around the nose casing.

19. A nose casing as claimed in claim 18, wherein the one or more circumferential grooves around the thread on the nose casing are arranged to align with an end of the locking nut in use.

20. A nose casing as claimed in claim 17, wherein the indicator means comprise one or more detents.

* * * * *